US005894291A

United States Patent [19]

Lee

[11] Patent Number: 5,894,291

[45] Date of Patent: Apr. 13, 1999

[54] SYSTEM AND METHOD FOR DYNAMICALLY COUNTERACTING SWAY IN ACTIVE ANTENNA TOWERS

[75] Inventor: David Y. Lee, Randolph, N.J.

[73] Assignee: Lucent Technologies, Inc., Murray Hill, N.J.

[21] Appl. No.: 08/761,056

[22] Filed: Dec. 5, 1996

[51] Int. Cl.[6] ..... H01Q 1/12

[52] U.S. Cl. ..... 343/890; 343/874

[58] Field of Search ..... 343/765, 890, 343/874, 757

[56] References Cited

U.S. PATENT DOCUMENTS

| | | | |
|---|---|---|---|
| 4,185,288 | 1/1980 | Dosch et al. | 343/765 |
| 4,596,989 | 6/1986 | Smith et al. | 343/709 |
| 4,956,947 | 9/1990 | Middleton | 52/1 |
| 5,128,683 | 7/1992 | Freedman et al. | 342/158 |

*Primary Examiner*—Don Wong
*Assistant Examiner*—Hoang Nguyen

[57] ABSTRACT

For use with an antenna tower, the antenna tower providing a mount for an active antenna that is subject to misdirection when the antenna tower sways, a system for, and method of, dynamically counteracting sway in the antenna tower. The system includes: (1) a rotation detector that senses a rotation, relative to a fixed reference plane, of a portion of the antenna tower proximate the active antenna and develops a sway signal indicative thereof and (2) antenna beam steering logic, coupled to the rotation detector, that receives the sway signal and modifies a drive signal provided to elements of the active antenna to redirect a beam projecting therefrom, the drive signal thereby compensated for the rotation to counteract the sway in the antenna tower. The system may form a portion of a wireless communications station.

20 Claims, 4 Drawing Sheets

SYSTEM AND METHOD FOR DYNAMICALLY COUNTERACTING SWAY IN ACTIVE ANTENNA TOWERS

TECHNICAL FIELD OF THE INVENTION

The present invention is directed, in general, to active antennas and, more specifically, to a system and method for dynamically counteracting sway in active antenna towers.

BACKGROUND OF THE INVENTION

The use of wireless telecommunications has undergone substantial growth in recent years and is projected to continue expanding as service improves and new products and features are offered. To retain existing customers and entice others to adopt wireless telecommunications, however, services must be provided at a reasonable price. Therefore, the cost of providing wireless telecommunication services must be reduced.

Conventional wireless systems provide service to geographical areas divided into circular or hexagonal cells; the division of the service provides a reason why such systems are commonly referred to as "cellular" systems. The number and size of these cells are selected by the service provider such that geographical coverage is optimized, cost is reduced, and capacity within the service area is maximized. Each cell is equipped with transmitters, receivers and antennas located at a cell site that is typically located near the geographical center of the cell. Each cell site within a particular service area is connected to a central office that serves as a mobile switching center ("MSC") and which controls mobile operation within the cells. The MTSO routes calls to and from other mobile units and the public switched telephone network ("PSTN").

As a practical matter, cell boundaries are not precise. The conventional hexagonal cell shape was chosen because it provides a practical way of covering an area without the gaps and overlaps in coverage that would occur if circular cells were used. Although circular cells could be serviced by omni-directional antennas, directional antennas are often used to reduce the number of required cells by increasing the coverage range for each cell, or to increase traffic capacity by decreasing inter-cell interference. Thus, considerable planning is needed to define the coverage area of each individual cell while minimizing the need to realign cells in the future.

Present cellular systems typically use 120° or 360° antennas mounted on a tower at each cell site. Because these antennas cover a wide angle, their use may limit either cell coverage due to low gain or system capacity due to high levels of interference. Therefore, more cells must be used to adequately service a geographical area and/or traffic load.

To maximize the geographical area and/or reduce inter-cell interference for each cellular site, it is desirable to use high-gain, directional antennas. These antennas are capable of covering a much greater distance than the low-gain, omni-directional antennas currently used by cellular systems. Thus, only one cell site would be required to cover the same geographical area that requires several cell-sites using typical low-gain, omni-directional antennas.

High-gain, directional antennas include multiple elements that can be excited by a drive signal at different power levels or phase angles to tailor the shape or direction of the antenna beam. In order to use such antennas for cellular service, it is necessary to house the antennas in a single structure atop an antenna tower. The required structure, however, presents a high wind load. Typical antenna towers used for cellular antenna sites are not perfectly rigid and are susceptible to sway, or structural bending, due to the wind load. If the antenna tower sways, the portion of the antenna tower proximate the active antenna is effectively rotated about its nominal position and the antenna beam direction is shifted. The shift of the antenna beam direction is not a problem for low-gain, omnidirectional antennas because of the relatively broad, short-range beam that characterizes such antennas. However, for a high-gain, directional antenna (having a relatively narrow, long-range beam), the shift would result in an erratic coverage area.

One possible solution to the problem of using high-gain, directional antennas for wireless communications systems is to use a more rigid antenna tower that is resistant to wind loads. This solution may defeat a principle advantage of using high-gain, directional antennas (i.e., lower cost system). The use of high-gain, directional antennas requires less cell sites to cover a given geographical area than if low-gain, omnidirectional antennas are employed. The savings realized from fewer cell sites would be offset by the increased cost necessary to provide more stable antenna structures. Furthermore, more-stable antenna towers might be too large to be located in a desired location.

An alternative to using more stable antenna structures with high-gain, directional antennas is to use a mechanical gimbal system to maintain the proper angular position of the antenna platform mounting atop the structure. U.S. Pat. No. 4,596,989, entitled "Stabilized Antenna System having an Acceleration Displacement Mass, by Smith et al., issued on Jun. 24, 1986, discloses a stabilized platform for use in connection with a satellite antenna mounted to a ship. The system includes an acceleration displaceable mass, and may include in combination a gimbal mounting and one or more gyros. Although this system might be adaptable to cellular antenna structures, such a mechanical system is extremely complex and susceptible to failure. Furthermore, unlike a ship, cell sites are generally unattended and, if a failure does occur, service would be lost for an extended period. Moreover, the mechanical nature of the system requires routine maintenance.

A second possible solution to using a more stable antenna structure with high-gain, directional antennas is to somehow counteract the tendency of less stable structures to bend due to wind loads. U.S. Pat. No. 4,956,947, entitled "Live Tendon System Inhibiting Sway of High Rise Structures and Method, by Middleton, issued on Sep. 18, 1990, discloses a live tendon system for inhibiting sway of high-rise structures. The system employs sensing means to detect a deflection of the structure, and a controller that actuates tension adjusting members coupled to the structure's main support members in response to the deflection. As with the mechanical gimbal system disclosed by Smith et al., a live tendon system is predominantly a mechanical system requiring routine maintenance to avoid failure. Furthermore, both the systems of Smith et al. and Middleton would substantially increase the cost of each cell site thereby diminishing the principle advantage of using high-gain, directional antennas for cellular systems.

Therefore, what is needed in the art is way of counteracting antenna tower sway that takes advantage of the inherent ability of an active antenna to be redirected by means of its electrical drive signal.

SUMMARY OF THE INVENTION

To address the above-discussed deficiencies of the prior art, the present invention provides, for use with an antenna tower, the antenna tower providing a mount for an active antenna that is subject to misdirection when the antenna tower sways, a system for, and method of, dynamically counteracting sway in the antenna tower. The system includes: (1) a rotation detector that senses a rotation, relative to a fixed reference plane, of a portion of the antenna tower proximate the active antenna and develops a sway signal indicative thereof and (2) antenna beam steering logic, coupled to the rotation detector, that receives the sway signal and modifies a drive signal provided to elements of the active antenna to redirect a beam projecting therefrom, the drive signal thereby compensated for the rotation to counteract the sway in the antenna tower.

In stark contrast with the prior art, the present invention introduces the concept of electrically altering the drive signal provided to the active antenna to redirect the beam as a function of the antenna tower sway. Therefore, for purposes of the present invention, "active antenna" is defined as an antenna having a beam that is steerable by modifying the drive signal fed to the antenna. Phased array antennas are one well-known type of active antenna. The present invention is specifically not directed to mechanically moving the elements of the active antenna; the elements are not actuated in the least.

As previously described, when the portion of the antenna tower proximate the active antenna rotates (as usually happens when the antenna tower sways in response to wind loads), the antenna is also physically rotated, and thus the antenna beam is subject to misdirection, perhaps substantially distorting the area desired to be covered by the beam. The present invention detects the rotation (such as a pitching forward, rearward, to either side or some combination thereof) and modifies the drive signal to the active antenna accordingly to redirect the beam as if the antenna were not rotated from its nominal position.

In one embodiment of the present invention, the sway signal contains information concerning a magnitude of the rotation and a direction of an axis thereof. It is most desirable to know the magnitude (i.e. pitch or rotation angle) and direction (i.e. azimuth) of the rotation for the beam to be redirected accurately. Accordingly, the system of the present invention may indicate, for example, that the portion is rotated purely forward (i.e., in the direction of the antenna beam) 0.5° at a given moment in time. The system counteracts the 0.5° purely forward pitch by redirecting the beam 0.5° up.

In one embodiment of the present invention, the rotation detector comprises a plurality of strain gauges that cooperate to measure a bending of the antenna tower. The degree to which the antenna tower bends determines the rotation of the portion of the antenna tower proximate the active antenna. Those skilled in the art will readily perceive other means by which the magnitude or the direction of the rotation may be determined. Thus, in related embodiments of the present invention, the rotation detector measures a characteristic of the portion of the antenna tower selected from the group consisting of: (1) displacement, (2) velocity and (3) acceleration.

In one embodiment of the present invention, the rotation detector comprises a two-dimensional level detector that measures a degree to which the portion of the antenna tower is out of level. Of course, it may not be necessary in some applications to counteract pitches to either side, for they may not affect the coverage area of the beam as much as do pitches forward or rearward. Accordingly, the present invention fully contemplates a one-dimensional embodiment wherein only forward or rearward pitches are sensed and counteracted. Those of skill in the art, however, will recognize that for use with typical cellular sites that provide multiple directional antennas for full 360° coverage, a two-dimensional detector is necessary to fully resolve the azimuth of rotation such that the drive signal for all active antennas can be modified. As used herein, the terms "angle of rotation," "sway" angle or "tilt" angle describe the degree to which the portion of the antenna tower to which the active antenna is mounted varies from horizontal; and the "azimuth" of rotation describes the compass direction in which the rotation, sway or tilt occurs.

In one embodiment of the present invention, the active antenna is a microwave antenna. Those skilled in the art are aware of the advantages of keeping a highly directional microwave beam as steady as possible for the purpose of maintaining reliable communication. However, other antennae and frequencies of operation are fully within the broad scope of the present invention.

In one embodiment of the present invention, the antenna elements cooperate to form a phased array. In a related embodiment, the drive signal is modified to adjust the relative phase of the drive signal provided to each element thereof. Alternatively or additionally, the drive signal may be modified by adjusting relative amplitudes of portions thereof. As those skilled in the art are aware, the beams of active antennas may be steered by altering relative phases or amplitudes (powers) of the components of the drive signal that are fed to the elements thereof. The present invention is not limited to a particular scheme for redirecting the beam as a function of antenna tower sway.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1A:
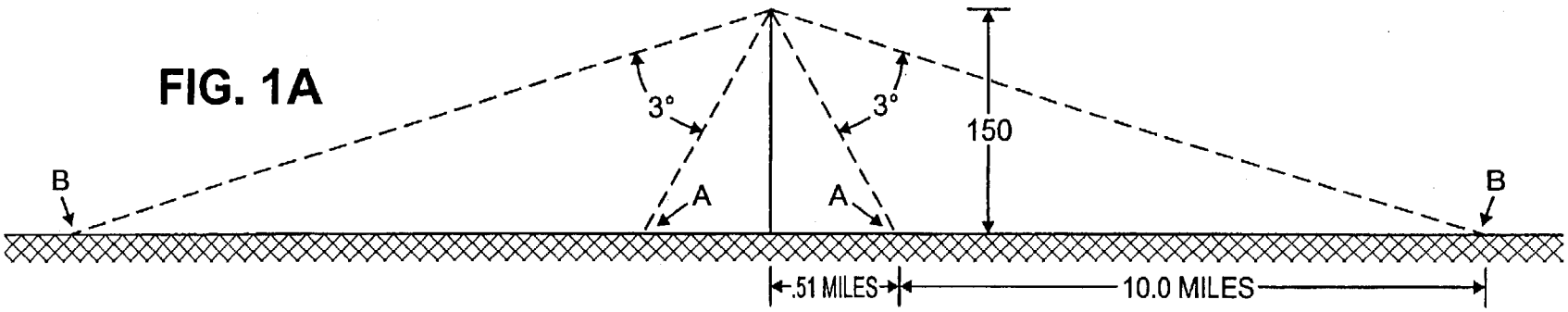
FIGS. 1A and 1B illustrate high-gain, directional antenna coverage patterns for a typical wireless communications antenna structure under nominal conditions and as affected by a 0.38° sway in the antenna tower, respectively.
Figure 1B:
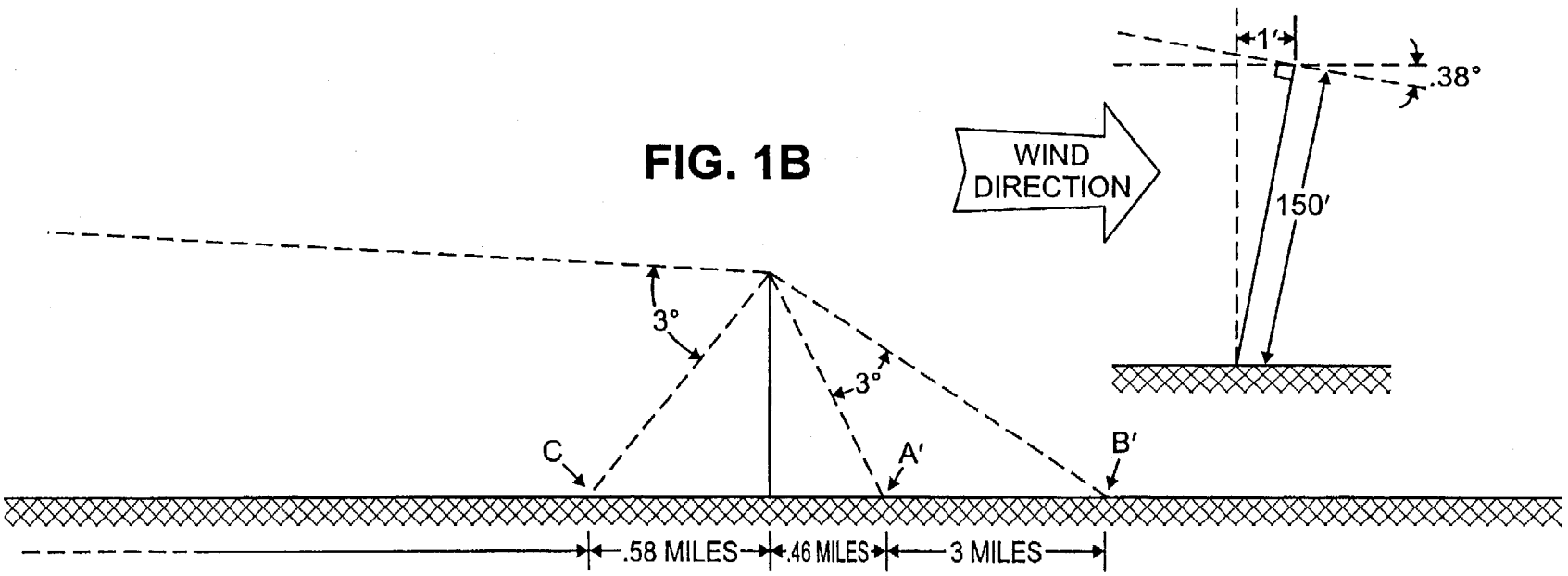

Referring initially to FIGS. 1A and 1B, illustrated are high-gain, directional antenna coverage patterns for a typical wireless communications antenna structure under nominal conditions and as affected by a 0.38° sway in the antenna tower, respectively. It should be noted that the dimensions and distances illustrated in each figure are not to scale. FIG. 1A illustrates a cross-section of an exemplary antenna pattern as projected, in opposite directions, by two high-gain, directional antennas having a three degree vertical beamwidth, as projected from the top of a 150 foot antenna tower. When the antenna tower is not subjected to a wind load, or otherwise caused to lean or sway, the antenna pattern will cover an area extending from approximately 0.51 miles (Point A) to 10 miles (Point B).

For purposes of illustrating the principles of the present invention, it is assumed that a wind load is capable of causing the top of the vertical antenna tower to sway, or deflect, one foot. It is also assumed that an antenna is mounted to a platform attached to the top of the antenna tower and that the platform is perpendicular to the nominal vertical axis of the tower (i.e., the platform is level). Those skilled in the art should recognize that a mere horizontal movement of the antenna tower does not significantly affect the antenna coverage area. However, whereas the base of the antenna tower is positionally fixed, it is recognized that a deflection of the top of the antenna tower can be modeled as a rotation of the tower about its base. Thus, a one foot deflection of the top of a 150 foot tower is equivalent to rotating the tower approximately 0.38 degrees about its base. It should also be recognized by those skilled in the art that this deflection will also cause the platform to which the antenna is mounted to tilt 0.38 degrees downward in the direction of the wind, and to tilt 0.38 degrees upward in a direction pointing into the wind. As used herein, the terms "angle of rotation," "sway" angle or "tilt" angle describe the degree of the portion of the antenna tower to which the active antenna is mounted varies from the horizontal due to the deflection of the top of the antenna tower; the "azimuth" of rotation describes the compass direction of the rotation, sway or tilt (i.e., deflection).

FIG. 1B illustrates the effect on the antenna coverage area due to a 0.38 degree vertical rotation of the antenna. In the direction of the wind, it can be seen that the antenna beam is shifted downward and that it will cover an area extending from approximately 0.46 miles (Point A') to 3 miles (Point B'). Thus the coverage area has decreased more than 70 percent, which would result in a loss of communications for mobile units within the range of 3 to 10 miles from the antenna. Similarly, in a direction pointing into the wind, the antenna beam would be shifted upward. The near boundary of the coverage area is shifted to approximately 0.58 miles (Point C) resulting in a small loss of coverage near the antenna. However, whereas the upper edge of the antenna beam is shifted above the horizontal, the far boundary of the antenna beam is extended to an indeterminate point away from the antenna. Thus, it would appear that, in a direction pointing into the wind, very little coverage would be lost. The deflection of the antenna beam, however, may have an adverse affect on the operation of mobile units in an adjacent cell into which the beam is shifted. Therefore, it is also desirable to avoid extending the antenna range into adjacent cells.

Figure 2:
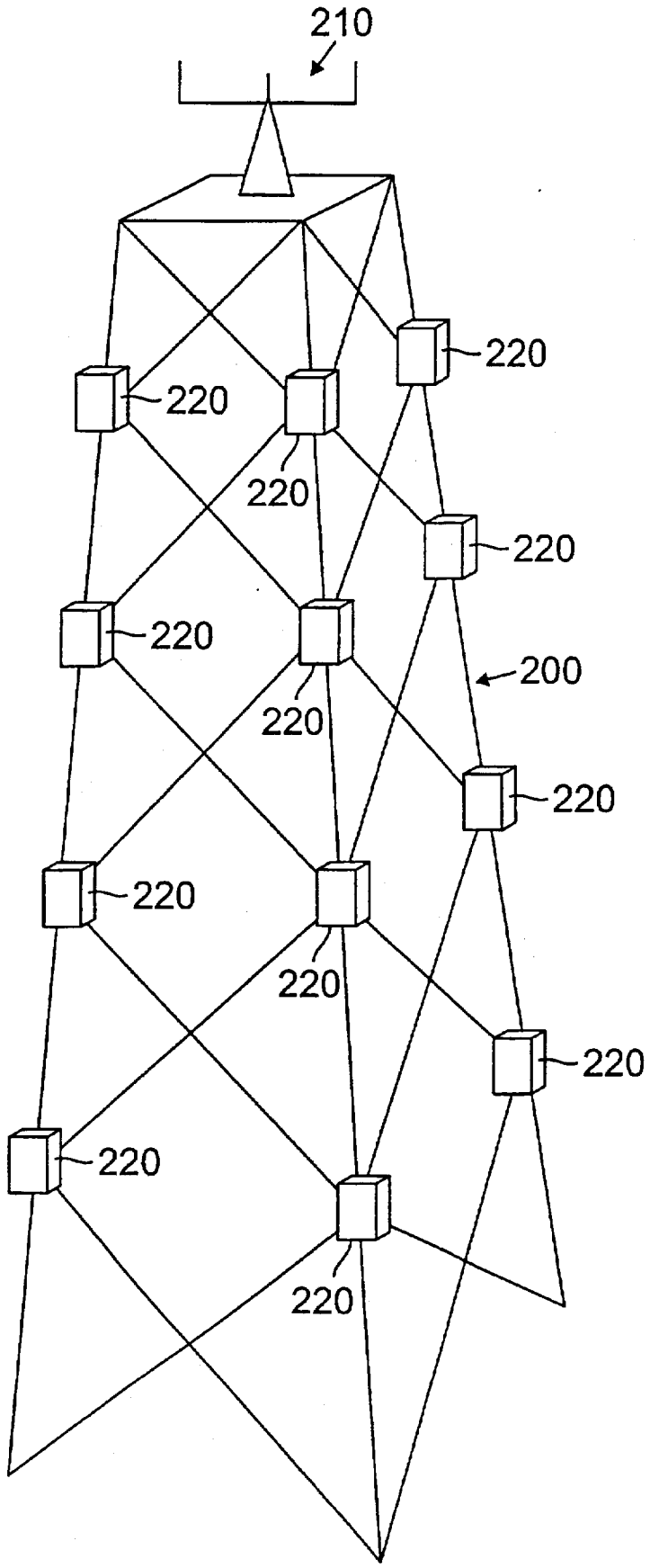
FIG. 2 illustrates an antenna tower, an active antenna mounted thereon and a rotation detector comprising a plurality of strain gauges that cooperate to measure a bending of the antenna tower.

Turning now to FIG. 2, illustrated is an antenna tower 200, an active antenna 210 mounted thereon and a rotation detector comprising a plurality of strain gauges 220 that cooperate to measure a bending of the antenna tower 200. The strain gauges 220 are selectively coupled to structural members of the antenna tower 200. The rotation detector processes signals received from each of the plurality of strain gauges 220 to compute a sway signal. The sway signal preferably includes the magnitude and direction (i.e., azimuth) of the sway (i.e., rotation) of a portion of the antenna tower proximate the active antenna 210. The portion of the antenna tower proximate the active antenna 210 is preferably a stable platform on which the antenna 210 is mounted. The computed sway signal is then transmitted to antenna beam steering logic (not shown), which uses the sway signal to modify a drive signal provided to elements of the active antenna 210. The modified drive signal redirects the beam of the active antenna 210 such that its nominal pointing angle is compensated for the rotation, thereby counteracting the sway (i.e. ,bending) in the antenna tower 200.

The degree to which the antenna tower bends determines the rotation of the portion of the antenna tower proximate the active antenna. Those skilled in the art will readily perceive other means by which the magnitude or the direction of the rotation may be determined. Thus, in related embodiments of the present invention, the rotation detector is operative to measure displacement, velocity or acceleration of selected members of the antenna structure, as necessary, to compute the sway signal.

Figure 3:
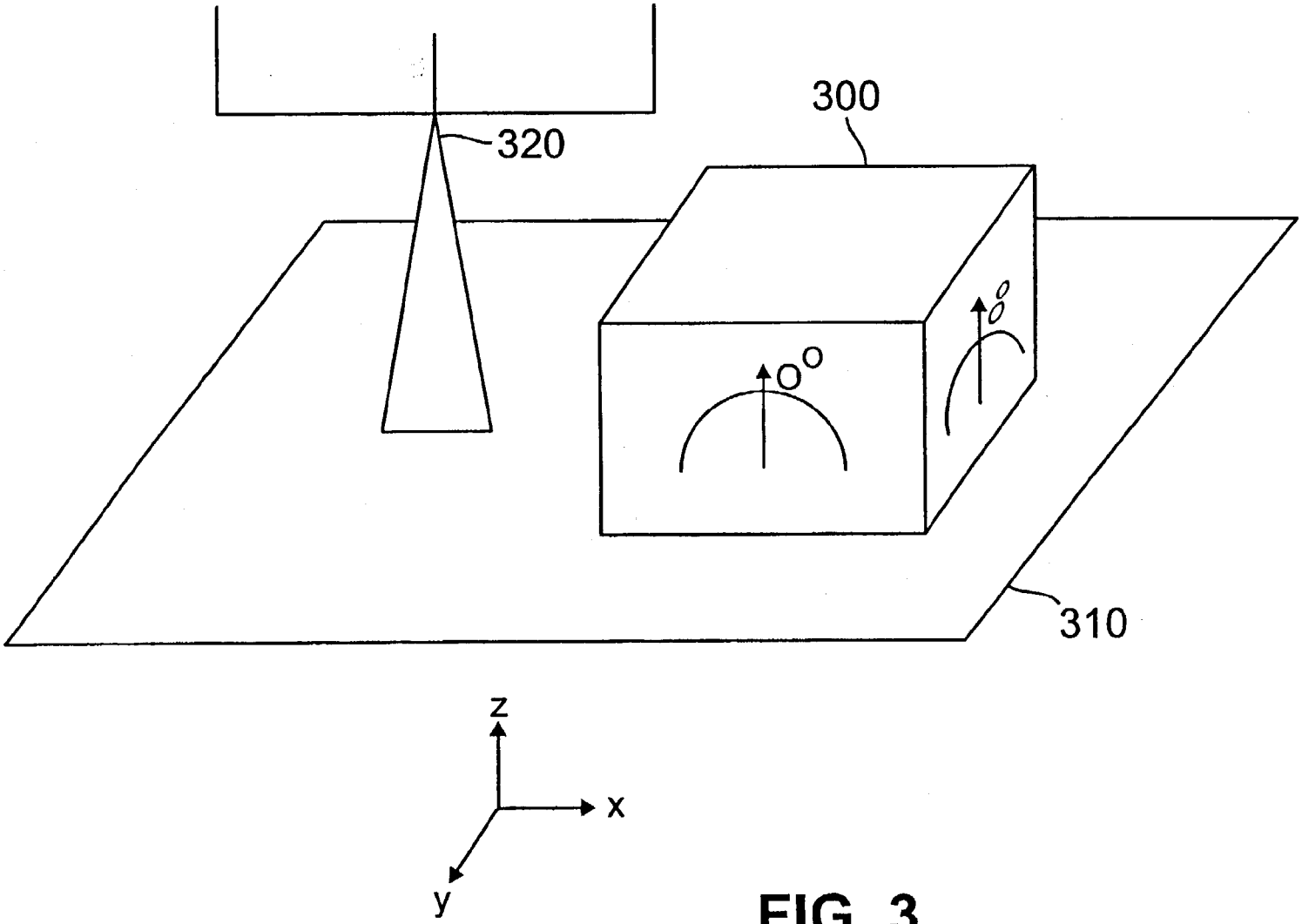
FIG. 3 illustrates a two-dimensional level detector that measures a degree to which the portion of the antenna tower is out of level.

Turning now to FIG. 3, illustrated is an embodiment of the present invention wherein the rotation detector comprises a two-dimensional level detector 300 that is operative to measure a degree to which the antenna is out of level. The level detector 300 is preferably mounted to a portion 310 of the antenna tower (not shown) that is proximate the mounting location of the active antenna 320. The two-dimensional level detector 300 is operative to determine the degree to which the portion 310 deviates from the nominal, or horizontal, plane. Those skilled in the art should recognize that the tilt angle of the portion 310, in any direction, may be computed from a determination of the tilt angle only in the x and y reference directions. It should be noted that the present embodiment of two-dimensional level detector 300 is introduced for illustrative purposes only; other level detector systems and apparatus, such as a mechanical or electrical apparatus, or combination thereof, including, without limitation, fluid or gyroscopic mechanisms, are well within the broad scope of the present invention.

Those skilled in the art should also recognize that it is not necessary in some applications to counteract pitches of the antenna tower to either side of the nominal pointing angle of an antenna; the pitches to either side, in some applications, do not affect the coverage area of the beam as much as pitches in a forward or rearward (i.e. aligned with the nominal pointing angle) direction. Accordingly, the present invention fully contemplates a one-dimensional embodiment wherein only forward or rearward pitches are sensed and counteracted. However, those skilled in the art should recognize that for use with typical cellular sites that use multiple directional antennas to provide full 360° coverage, a two-dimensional detector is necessary in order to fully resolve the azimuth of rotation such that the drive signal for a plurality of co-located active antennas can be modified.

Figure 4:
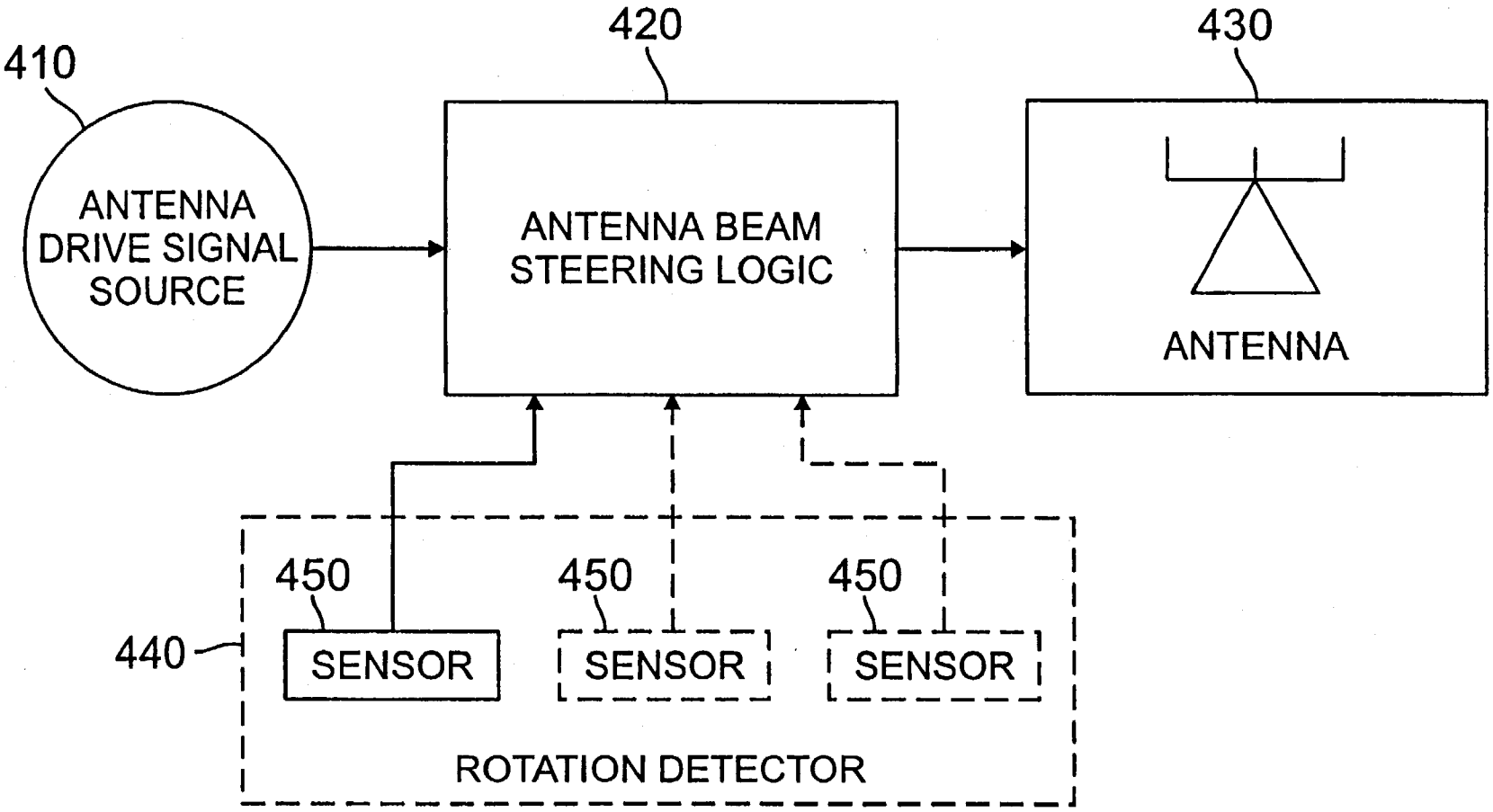
FIG. 4 illustrates a block diagram of the system for dynamically counteracting sway in an active antenna tower according to the present invention.

Turning now to FIG. 4, illustrated is a block diagram of the system for dynamically counteracting sway in an active antenna tower according to the principles of the present invention. A conventional active antenna system includes an antenna coupled to an antenna drive signal source. The drive signal source delivers signal power to the elements of the antenna such that a beam having desired characteristics is projected therefrom. According to the principles of the present invention, a drive signal for an antenna 430 is received by antenna beam steering logic 420 from an antenna drive signal source 410. The antenna beam steering logic 420 modifies the drive signal in response to a sway signal received from a rotation detector 440. The rotation detector 440 includes at least one sensor 450. In one embodiment, the sensors 450 are a plurality of strain gauges that cooperate to measure a bending of the antenna tower. The degree to which the antenna tower bends determines the rotation of the antenna tower proximate the active antenna 430. In another embodiment, a sensor 450 includes a two-dimensional level detector that measures a degree to which a portion of the antenna tower proximate the active antenna 430 is out of level. The rotation detector 440 develops a sway signal indicative of the rotation of a portion of the antenna tower proximate the mounting location of active antenna 430. In response to the sway signal from rotation detector 440, the antenna beam steering logic 420 modifies a drive signal received from the antenna drive signal source 410 and provides the modified drive signal to elements of the active antenna 430, thereby redirecting an antenna beam projecting therefrom (i.e., the drive signal is compensated to counteract the sway in the antenna tower). Thus, the present invention introduces the concept of electrically altering the drive signal provided to an active antenna to thereby redirect the antenna beam as a function of antenna tower sway.

Although the present invention and its advantages have been described in detail, those skilled in the art should understand that they can make various changes, substitutions and alterations herein without departing from the spirit and scope of the invention in its broadest form.

What is claimed is:

1. For use with an antenna tower, said antenna tower providing a mount for an active antenna that is subject to misdirection when said antenna tower sways, a system for dynamically counteracting sway in said antenna tower, comprising:

a rotation detector that senses a rotation, relative to a fixed reference plane, of a portion of said antenna tower proximate said active antenna and develops a sway signal indicative thereof; and antenna beam steering logic, coupled to said rotation detector, that receives said sway signal and modifies a drive signal provided to elements of said active antenna to redirect a beam projecting therefrom, said drive signal thereby compensated for said rotation to counteract said sway in said antenna tower.

2. The system as recited in claim 1 wherein said sway signal contains information concerning a magnitude of said rotation and a direction of an axis thereof.

3. The system as recited in claim 1 wherein said rotation detector comprises a plurality of strain gauges that cooperate to measure a bending of said antenna tower.

4. The system as recited in claim 1 wherein said rotation detector comprises a two-dimensional level detector that measures a degree to which said portion of said antenna tower is out of level.

5. The system as recited in claim 1 wherein said active antenna is a microwave antenna.

6. The system as recited in claim 1 wherein said elements cooperate to form a phased array.

7. The system as recited in claim 1 wherein said drive signal is modified to adjust relative phases of portions thereof.

8. For use with an antenna tower, said antenna tower providing a mount for an active antenna that is subject to misdirection when said antenna tower sways, a method of dynamically counteracting sway in said antenna tower, comprising the steps of:

sensing a rotation, relative to a fixed reference plane, of a portion of said antenna tower proximate said active antenna; and modifying a drive signal provided to elements of said active antenna to redirect a beam projecting therefrom, said drive signal thereby compensated for said rotation to counteract said sway in said antenna tower.

9. The method as recited in claim 8 wherein said sway signal contains information concerning a magnitude of said rotation and a direction of an axis thereof.

10. The method as recited in claim 8 wherein said step of sensing comprises the step of measuring a bending of said antenna tower.

11. The method as recited in claim 8 wherein said step of sensing comprises the step of measuring a degree to which said portion of said antenna tower is out of level.

12. The method as recited in claim 8 wherein said active antenna is a microwave antenna.

13. The method as recited in claim 8 wherein said elements cooperate to form a phased array.

14. The method as recited in claim 8 wherein said step of modifying comprises the step of modifying said drive signal to adjust relative phases of portions thereof.

15. A wireless communications station, comprising:

an antenna tower;

a steerable beam antenna, comprising a phased array of elements, that is subject to misdirection when said antenna tower sways;

a rotation detector that senses a rotation, relative to a fixed reference plane, of a portion of said antenna tower proximate said antenna and develops a sway signal indicative thereof; and antenna beam steering logic, coupled to said rotation detector, that receives said sway signal and modifies a drive signal provided to said phased array to redirect a beam projecting therefrom, said drive signal thereby compensated for said rotation to counteract said sway in said antenna tower and avoid said misdirection.

16. The wireless communications station as recited in claim 15 wherein said sway signal contains information concerning a magnitude of said rotation and a direction of an axis thereof.

17. The wireless communications station as recited in claim 15 wherein said rotation detector comprises a plurality of strain gauges that cooperate to measure a bending of said antenna tower.

18. The wireless communications station as recited in claim 15 wherein said rotation detector comprises a two-dimensional level detector that measures a degree to which said portion of said antenna tower is out of level.

19. The wireless communications station as recited in claim 15 wherein said rotation detector measures a characteristic of said portion of said antenna tower selected from the group consisting of:

displacement, velocity, and acceleration.

20. The wireless communications station as recited in claim 15 wherein said drive signal is modified to adjust relative phases of portions thereof.

* * * * *